US006755774B1

(12) United States Patent
Nosaka

(10) Patent No.: US 6,755,774 B1
(45) Date of Patent: Jun. 29, 2004

(54) METHOD OF AUTOMATICALLY PRODUCING BAGS WITH HOLES AND APPARATUS THEREFOR

(75) Inventor: Seiji Nosaka, Hiroshima (JP)

(73) Assignee: Nikko Shoji Co., Ltd., Hiroshima (JP)

( * ) Notice: Subject to any disclaimer, the term of this patent is extended or adjusted under 35 U.S.C. 154(b) by 40 days.

(21) Appl. No.: 09/613,459

(22) Filed: Jul. 10, 2000

(30) Foreign Application Priority Data

Jul. 8, 1999 (JP) ..... 11-194751

(51) Int. Cl.[7] ..... B31B 1/14; B31B 23/14

(52) U.S. Cl. ..... 493/186; 493/189; 493/205; 493/269; 493/288

(58) Field of Search ..... 493/186, 189, 493/205, 269, 288

(56) References Cited

U.S. PATENT DOCUMENTS 2,358,455 A * 9/1944 Hallman ..... 156/380.1
3,663,075 A * 5/1972 Kronenberg ..... 310/90.5
4,166,412 A * 9/1979 Versteege ..... 156/514
4,481,006 A * 11/1984 LaFleur et al. ..... 493/194
4,680,023 A * 7/1987 Varano ..... 271/3.01
5,009,740 A * 4/1991 Yanai ..... 156/353
5,899,047 A * 5/1999 Weder et al. ..... 206/423
5,923,109 A * 7/1999 Higuchi et al. ..... 310/90.5
5,951,788 A * 9/1999 Holmberg ..... 148/307
6,186,933 B1 * 2/2001 DeMatteis ..... 493/193
6,523,331 B1 * 2/2003 Fresnel ..... 53/557

OTHER PUBLICATIONS

Patent Abstracts of Japan, "Hot Fusing and Sticking Machine, Blade Body and Method Therefor", Kyoei KK (E. Sugimoto), Publ. #03–124428 dated May 28, 1991 & JP 5–67414.

Patent Abstracts of Japan, "Fusion Cutting and Adhering Machine", Kyoei KK (E. Sugimoto), Publ. #07–299873 dated Nov. 11, 1995 & JP 2640729.

* cited by examiner

*Primary Examiner*—Rinaldi I. Rada
*Assistant Examiner*—Gloria R Weeks
(74) *Attorney, Agent, or Firm*—Griffin & Szipl, PC

(57) ABSTRACT

Protective bags made of a plastic film have heretofore been produced by folding two pieces of films by hand, and it is very difficult to mass-produce asymmetrical bags at a low cost. Protective bags made of a film bearing any design are now continuously produced at high speeds by using a film tube blank, inserting a floating separator in the film tube blank, forming openings with symmetrical or asymmetrical continuous or discrete cut lines in the upper and lower surfaces or in both side surfaces in a state where motion of the film tube blank is stopped, depending upon the length of the bag, and cutting the film tube blank at the melt-adhered portion using a cutting edge extending in the direction of width.

22 Claims, 5 Drawing Sheets

$5mm \leq T_1 - T_2 (= \Delta T) \leq 100mm$ $5mm \leq T_1 - T_2 (= \Delta T) \leq 100mm$

METHOD OF AUTOMATICALLY PRODUCING BAGS WITH HOLES AND APPARATUS THEREFOR

BACKGROUND OF THE INVENTION

1. Field of the Invention

The present invention relates to a method and an apparatus for automatically producing bags with openings. More specifically, the invention relates to a machine equipped with a floating separator for automatically producing bags with openings by using a film tube as a blank, the machine being capable of highly efficiently forming split lines in a portion of the film tube, for example, in an upper half portion only of the film tube, to form openings, or forming many small holes at one time.

2. Background Art

A protective bag made of a plastic film such as thermoplastic polyolefin resin film, e.g., polyethylene (PE) or polypropylene (PP) or thermoplastic resin film, e.g., nylon, PVC, PVA, EVA, PS or PET (inclusive of a laminate thereof), used for sheets for automobiles and as other protective covers, has been produced by stacking a large number of, for example, several tens to several hundreds of pieces of films cut into the shape of a sheet one upon the other to form large and small openings, and melt-adhering the required portions.

In the case of producing a bag having asymmetrical openings in the upper and lower surfaces, in particular, double-size blanks are stacked to execute the searing or opening, and the films are folded piece by piece and are melt-adhered.

This conventional method is suited for producing many kinds of bags in small quantities, involving, however, much manual work, resulting in an increase in the cost of production, still accompanied by troubles in quality such as poor openings, poor melt-adhesion and the like. Besides, the yield of production is never high.

Japanese Examined Patent Publication (Kokoku) No. 67414/1993 discloses an improved mechanism for heat-melting and adhesion, according to which two pieces of overlapped synthetic resin films are cut using a heated blade, and the cut ends are melt-adhered together by heating. With this mechanism, however, the two pieces of overlapped films can only be cut and melt-adhered simultaneously without accomplishing such a sophisticated work that a portion of the film or the tubular blank is cut and is opened to melt-adhere at least a portion corresponding to the bottom of the bag. In other words, it was not possible to simultaneously form asymmetrical openings in the upper and lower surfaces of the protective bag.

SUMMARY OF THE INVENTION

It is a first object of the present invention to produce protective bags of a plastic film having large and small openings which are symmetrical or asymmetrical in both surfaces at a decreased cost and at a high speed.

It is a second object of the present invention to produce protective bags of a plastic film of stable and high quality, without significant variation in quality, in large quantity.

The present invention is concerned with a method of automatically producing bags with openings by inserting a plate-like floating separator in a film tube blank that moves in the lengthwise direction, the plate-like floating separator being limited from moving in the direction of width and in the direction of progress, and forming openings or executing the melt-adhesion in at least one surface of the film tube blank during an intermittent stoppage of motion of the film tube blank.

In a further embodiment, the invention relates to a method of automatically producing bags with openings as described above, wherein the floating separator is electromagnetically supported, and its movement in the direction of width or in the direction of progress is limited by rolls and/or an endless belt and/or fixed guides.

In a still further embodiment, the invention relates to an apparatus for automatically producing bags with openings comprising a pay-off reel for supplying an intimately adhered film tube blank, a loop device, at least one melt-adhering device, an opening device, a predetermined length-drawing device and a cutting device, wherein a floating separator is inserted in the film tube blank on a side of entering into the opening device, the floating separator being limited from moving in the direction of forward progress of the blank and in the direction of the width of the blank. The floating separator further serves as a cradle for forming openings in at least the upper surface by using an opening punch.

In another embodiment, the invention relates to an apparatus for automatically producing bags with openings, as above, wherein the opening punch is a shearing relief or a heated relief.

In yet another embodiment, the invention relates to an apparatus for automatically producing bags with openings according to one of the above-described embodiments, wherein the searing relief has an opening portion of a relatively wide area for passing a protruded portion of a material packaged in a product bag, and the heated relief has an opening portion of a relatively small area for passing a cord or a rubber cord used for fastening the opening or the periphery of the opening after a material is packaged in the product bag.

In another embodiment, the invention relates to an apparatus for automatically producing bags with openings according to one of the above embodiments, wherein the opening portion is an incomplete opening portion leaving a blank continuing portion in a portion thereof.

In a further embodiment, the invention relates to an apparatus for automatically producing bags with openings according to one of the above embodiments, wherein means for limiting the movement of the floating separator in the direction of progress of the blank is constituted by a pair of upper and lower rolls that are symmetrically arranged to come in contact with the upper and lower surfaces of the blank satisfying a relation $T_1>T_2$, wherein $T_1$ is the thickness of the floating separator and $T_2$ is a gap between the rolls.

In a still further embodiment, the present invention relates to an apparatus for automatically producing bags with openings according to one of the above embodiments, wherein means for limiting the movement of the floating separator in the direction of progress of the blank comprises rolls asymmetrically arranged up and down and/or an endless belt and/or fixed guides.

In a yet further embodiment, the present invention relates to an apparatus for automatically producing bags with openings according to the above embodiment, wherein means for limiting the movement of the floating separator and of the film tube blank in the direction of width comprises at least a pair of rollers arranged on the outer sides of the blank in the direction of the width of the blank and pivotally attached to the base plate along a nearly vertical axis and/or an endless belt and/or fixed guides.

In another embodiment, the present invention relates to an apparatus for automatically producing bags with openings according to one of the above embodiments, wherein the melt-welding device is a linear heat welder of one stage or of a plurality of stages.

Further objects, features and advantages of the present invention will become apparent from the description of the Preferred Embodiments, when considered together with the attached drawings.

DESCRIPTION OF THE PREFERRED EMBODIMENTS

Figure 1:
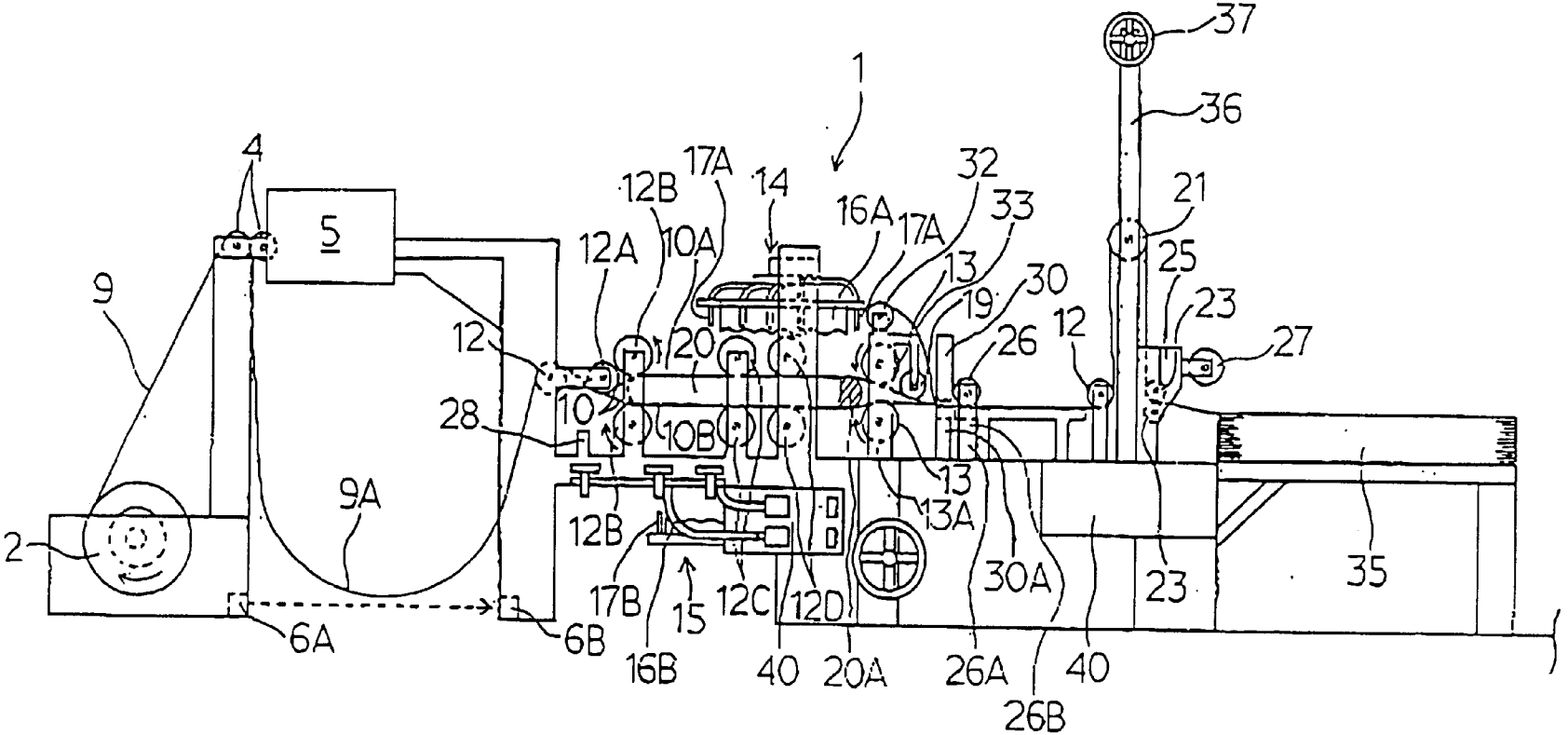
FIG. 1 is a side view illustrating an embodiment of the present invention.
Figure 2:
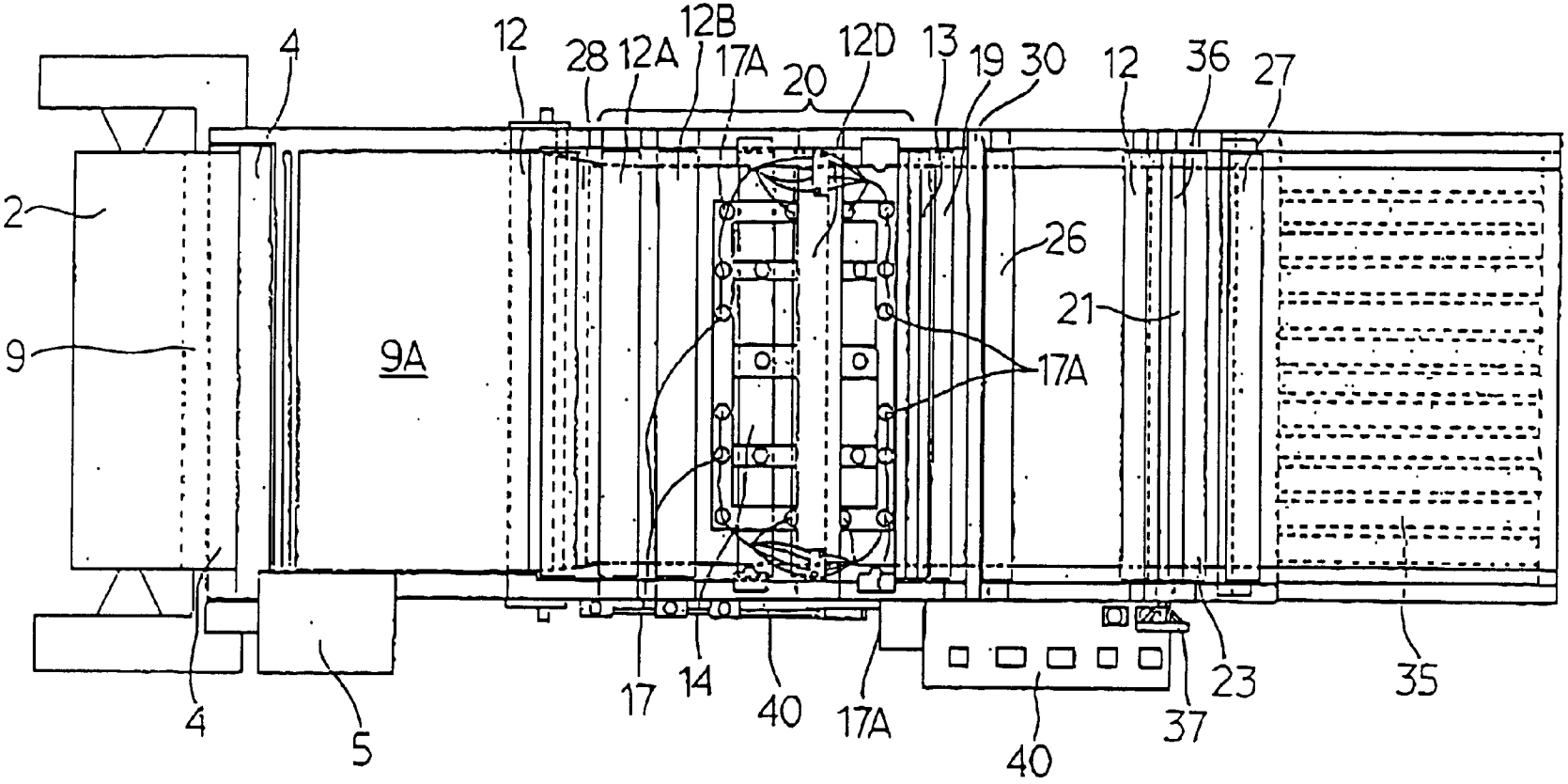
FIG. 2 is a plan view of the embodiment of FIG. 1.
Figure 3:
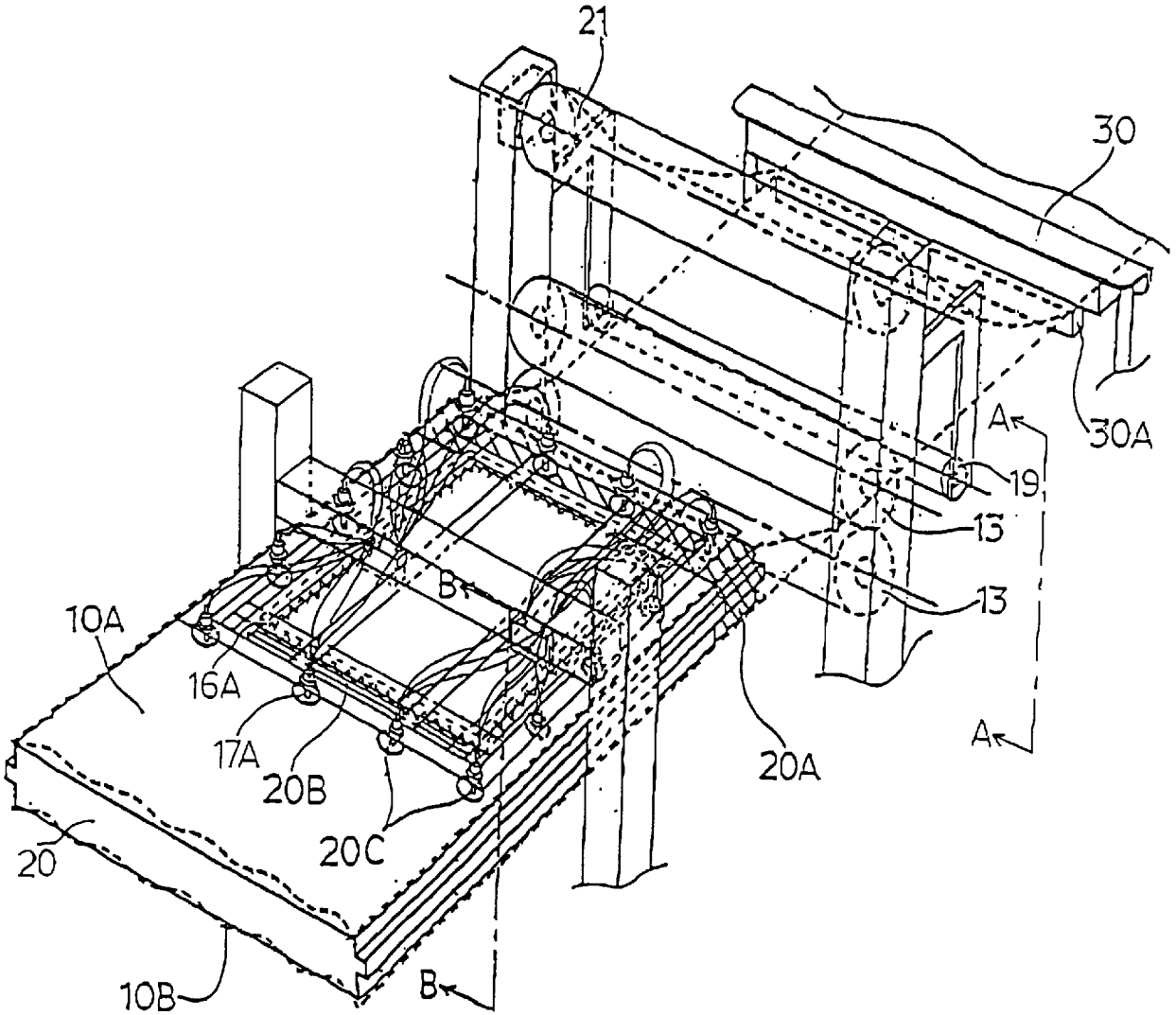
FIG. 3 is a perspective view illustrating a major portion of the above embodiment.

The invention will now be described in detail by way of certain preferred embodiments.

In the drawings, reference numeral 2 denotes a pay-off reel, 4 denotes pinch rolls of an inlet side, 5 denotes a pinch roll drive unit of the inlet side, reference numerals 6A and 6B denote photoelectric tube devices, 9 denotes an intimately adhered film tube blank, 9A denotes a loop, 10 denotes separated film tubes, 10A denotes an upper surface of the film tube, 10B denotes a lower surface of the film tube, reference numerals 12, 12A, 12B, 12C and 12D denote rolls, 13 denotes a roll for limiting the direction of progress, 13A denotes a support portion for supporting the roll for limiting the direction of progress, 14 denotes an upper surface opening device, 15 denotes a lower surface opening device, 16A denotes a down-cut edge, 16B denotes an up-cut edge, 17A denotes a down-directed heat punch, 17B denotes an up-directed heat punch, 19 denotes a wrinkle-removing roll (convex roll), 20 denotes a floating separator, 20A denotes a bite-preventing end, 20B denotes an open groove, 20C denotes a punch groove, 20E denotes an end roll, 21 denotes a tension roll, 22 denotes a deflector roll, 22A denotes an auxiliary roll, 23 denotes pinch rolls (drive rolls) on the outlet side, 25 denotes a plain-blade cutter, 26 denotes an air-blow cooler, 26A denotes air-blow nozzles, 26B denotes an air-blow cooler support portion, 27 denotes an air-blow feeder with means for removing static electricity, 28 denotes means for removing static electricity, 30 denotes a melt-adhering device (heat sealer), 30A denotes a cradle for the melt-adhering device, 31 denotes a brake which can give back tension to resin film 33 described below, 32 denotes a roll of fluorine-contained resin film, 33 denotes a fluorine-contained resin film, 35 denotes a stack of product bags, 36 denotes a portal housing, 37 denotes a handle for adjusting the tension roll, 38 denotes an endless belt, 40 denotes a control board, 50 denotes an electromagnet, and 51 denotes a mild steel plate.

The embodiment 1 includes the pay-off reel 2, a pair of inlet-side pinch rolls 4, 4 for pulling the intimately adhered film tube member 9 wound on reel 2, and the inlet-side pinch roll drive device 5 containing a motor and a reduction gear for driving the pinch rolls. The loop 9A is formed between the pinch rolls 4, 4 and the roll 12, and the length of the loop 9A is controlled by the photoelectric tube devices 6A and 6B based on a difference in the circumferential speed between the roll 12 and the pinch rolls 4, 4. The floating separator 20 is inserted in the film tube 10 between the roll 12A and the pair of rolls 13, 13 for limiting the direction of forward progress of separator 20.

The floating separator 20 is in the form of a plate which is light in weight, rigid to some extent, resistant against the heat and has a smooth and slippery surface, and has, at an end on the outlet side thereof, a bite-preventing end 20A formed of an FRP core member (comprising, for example solid or hollow fiber reinforced plastic) covered with a stainless steel, or formed of a corrosion-resistant metal such aluminum, aluminum alloy, copper-containing metal, e.g., brass, bronze, or a stainless steel, to prevent biting caused by the rolls 13, 13 that limit the movement in the direction of forward progress. An end roll 20E may be pivotally attached to an end of the bite-preventing end 20A.

The whole material of the floating separator may be a plastic casting (solid) member such as a hard and highly dense PE (polyethylene) or a less dense PE, PP (polypropylene), PS (polystyrene), ABS (acrylonitrilbutadiene styrene), PET (polyethylene terephthalate), a hollow member, a framed member or an FRP. Further, the floating separator 20 may have a honeycomb structure or may be any other hollow molded article, or a carbon fiber-reinforced plastic. Therefore, the floating separator 20 of the present invention can be made by using a corrugated cardboard or a plastic-impregnated paper.

As will be described later, the floating separator 20 receives shearing stress repetitively from the opening/melt-adhering device, and/or is repetitively heated, and its surface tends to be damaged. To cope with this, the surface of the floating separator is coated with a fluorine-contained resin such as PTFE, PFA, PFEP or PETFE, to maintain a small coefficient of friction $\mu$ relative to the film tube 10 and to maintain a strength on the surface against heat.

In any way, the floating separator 20 must be rounded at its corners, must have a highly smooth surface, must have a particularly small coefficient of friction $\mu$ relative to the inner surface of the film tube, and must have heat resistance.

No matter how light a material is used, the weight of the floating separator cannot be brought to zero. Therefore, the pressure of the lower surface to the support roll becomes necessarily larger than the pressure of the upper surface. When the upper and lower surfaces of the tube film are simultaneously subjected to machining such as perforation, shearing or melt-adhesion, the lower film 10B tends to be torn out or is broken at the melt-adhered portion compared to the upper film 10A. To cope with this, the following means can be provided.

When, for example, a single layer or a laminated layer of mild steel plates or a plastic molded member in which ferrite is dispersed, is used as a core member of the floating separator 20, magnetic force can be imparted to cancel the separator 20's own weight using a stationary electromagnet provided on the upper surface and/or on the lower surface. In this case, if a roll incorporating a plurality of electromagnets is disposed on the upper side and/or on the lower side, the magnetic force can be imparted without occupying any additional space.

Next, the opening device 14 and the melt-adhering device 15 will be described in detail.

Figure 5:
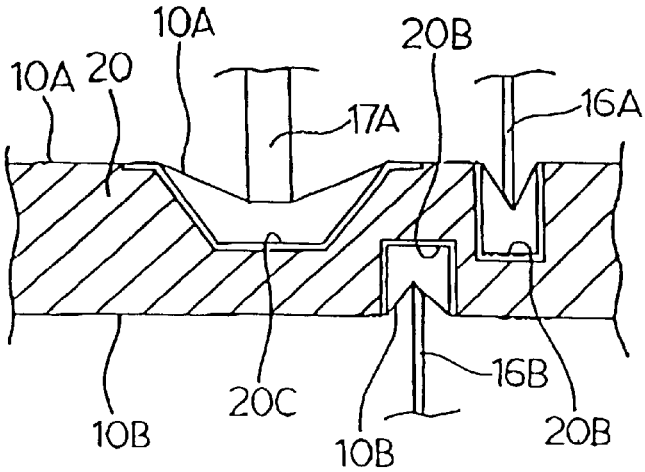
FIG. 5 is a sectional view along the line B—B in FIG. 3.

In FIGS. 1 and 5, the lower surface opening device 15 is a film tube-machining unit including the cut edge 16B and the up-directed heat punch 17B, and the upper surface opening device 14 is a film tube-machining unit including the down-cut edge 16A and the down-directed heat punch 17A. These edges and punches execute the machining in nearly the vertical direction in a state where the film tube 10 is supported by the upper and lower surfaces of the floating separator 20, thereby forming openings by cutting and perforating by punching. The cutting edge is usually a shearing blade which can be of various shapes such as a U-shape or a square shape on a plane, and the heated punches have a round shape (cylindrical) and are electrically heated. The active surface of the heated punch may be in an elongated plate shape.

The film tube 9 that is opened on the upper and lower surfaces of the floating separator 20 moves forward (toward the right in FIG. 1) being driven by the pinch rolls 23, 23 on the outlet side while being squeezed by the pair of rolls 13, 13 for limiting the movement in the direction of forward progress, and is stopped after every predetermined length due to a pulse counter (not shown) incorporated in either one of the pinch rolls 23, 23 on the outlet side, and the upper and lower surfaces thereof are sandwiched by the heat sealer 30 and the cradle 30A so as to be heated and melt-adhered together. Here, the tension roll 21 moves up and down along a pole of the portal housing 36 to work as a looper.

During this period, wrinkles of the film tube are removed by the wrinkle-removing roll 19 which is a convex roll being imparted with roll crown. By using a shaft with a ratchet gear, the roll 32 of the fluorine-contained resin film 33 is pivotally attached at an upper end of the portal support member 13A for supporting the rolls 13, 13 that limit the movement in the direction of forward progress, and the fluorine-contained resin film strip 33 extends near to the deflector roll 12. The fluorine-contained resin film 33 works to prevent melt-adhesion between the heat sealer 30 and the upper surface 10A of the film tube.

The active end of the heat sealer 30 is in the form of parallel linear edges of an even number extending in parallel in the direction of a width of the line. After being melt-adhered, an intermediate portion of the parallel linearly melt-adhered portion of the film tube in the direction of width is cut using a plain-blade cutter 25 to produce a product bag which is stacked on the stack 35 of product bags. The steps of executing the opening, melt-adhesion and cutting are successively executed in a halted state every after one to four product bags. In order to cool the film tube after working, normal-temperature (room temperature) air or cooled air is blown from the air-blow nozzles 26A of the air-blow cooler 26 supported by the air-blow cooler support member 26B. Further, the hollow, ice candy-like film tube 9, after working, which is continuous when viewed from the side, is cut at the melt-adhered portion by the plain-blade cutter 25 shown in FIG. 1, and is stacked on the stack 35 of product bags.

In the present invention, what is important is that continuous/noncontinuous openings and round openings are formed by using the floating separator 20 in the upper and lower surfaces or in the side surfaces in an asymmetric manner to match the use and requirements of the product, and, besides, a printer is used in combination, to mass-produce the protective bags with desired openings which have also been printed at a decreased cost. Working is rarely carried out on the side surfaces.

Figure 4:
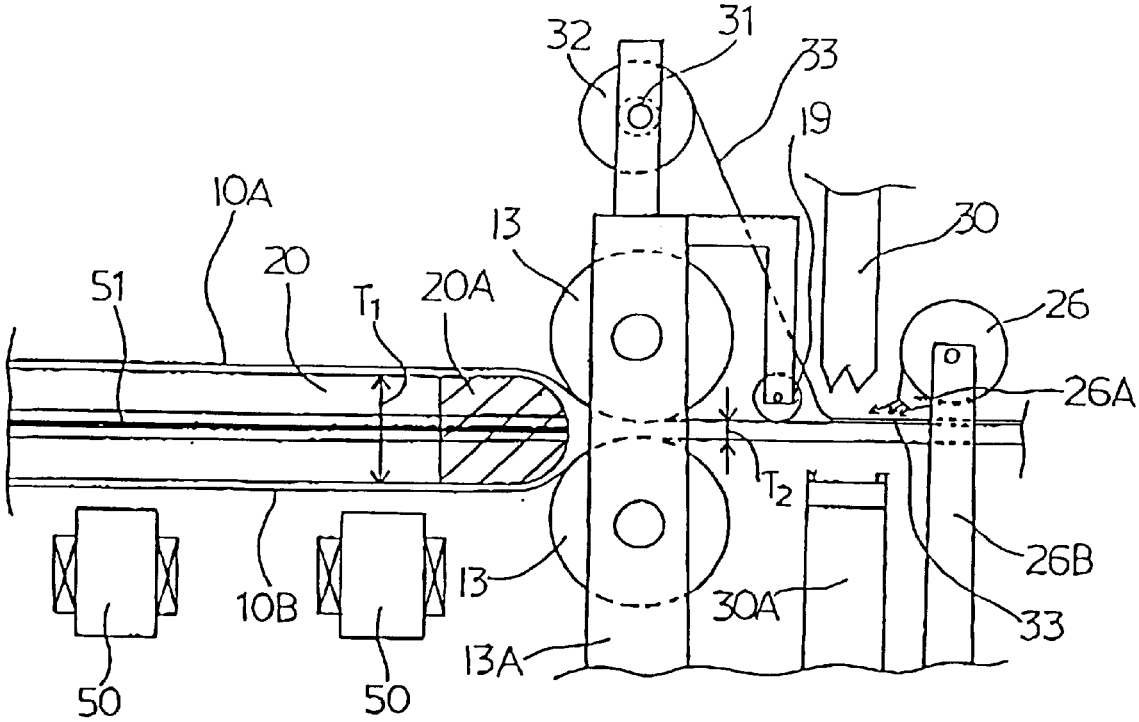
FIG. 4 is a sectional view along the line A—A in FIG. 3.

In FIG. 4, $T_1$ is the thickness of the floating separator, and $T_2$ is the roll gap between the rolls 13, 13 that limit the direction of forward progress of the floating separator 20.

Here, if $T_1>T_2$ and $\Delta T=T_1-T_2$, then, $\Delta T$ is in a range of from 5 to 100 mm from a practical point of view. Desirably, $\Delta T$ lies in a range of from 10 to 30 mm. When $\Delta T$ is not larger than 5 mm, it is likely that the floating separator 20 is bitten between the rolls 13, 13 (though this varies depending upon the ratio of rigidity between the bite-preventing end 20A and the rolls 13, 13). When $\Delta T$ exceeds 100 mm, on the other hand, the contact area increases between the floating separator 20 and the bite-preventing end, developing such undesirable occurances as breakage of the film. Usually, $\Delta T$ is set to lie in a range of from 10 to 30 mm.

The devices for executing the above steps may be arranged to reciprocally move at one time in the direction of the line to make up the apparatus of a reciprocal stamping type to produce the bags. This causes, however, the apparatus to become bulky.

In FIG. 4, further, plural electromagnets 50 are attached to a support frame to produce lines of magnetic force in the vertical direction under the floating separator 20. A mild steel plate 51, which is a member sensitive to magnetism, is arranged in the floating separator 20 nearly at a central portion in the direction of thickness thereof, and is indirectly lifted up in a noncontacting manner. If the electromagnets 50 are contained in a suitable vacuum container and are maintained at a very low temperature close to absolute zero (−273° C.), then, the floating separator 20 can be maintained in nearly a gravity-free state for a while even when the power source is turned off after the solenoid has been energized.

Referring to FIG. 5, the upper and lower surfaces 10A, 10B of the separated film tube 10 are cut or thermally perforated as if along a string in cross section due to the opening groove 20B formed in the floating separator 20, down-cut edge 16A pressed into the punch groove 20C, up-cut edge 16B, down-directed heat punch 17A and up-directed heat punch 17B. Here, the ends of the cut edges 16A, 16B and heat punches 17A, 17B are not contacting the floating separator 20. The working such as cutting can also be accomplished even with the film tube in contact with the surface of the floating separator 20 like cutting on a chopping board. Upon forming the opening groove 20B and punch groove 20C in the surface of the floating separator 20, however, the working can be accomplished while floating the film tube 10A, 10B without contacted to the back surface of grooves 20B and 20C, while maintaining stability.

Figure 6:
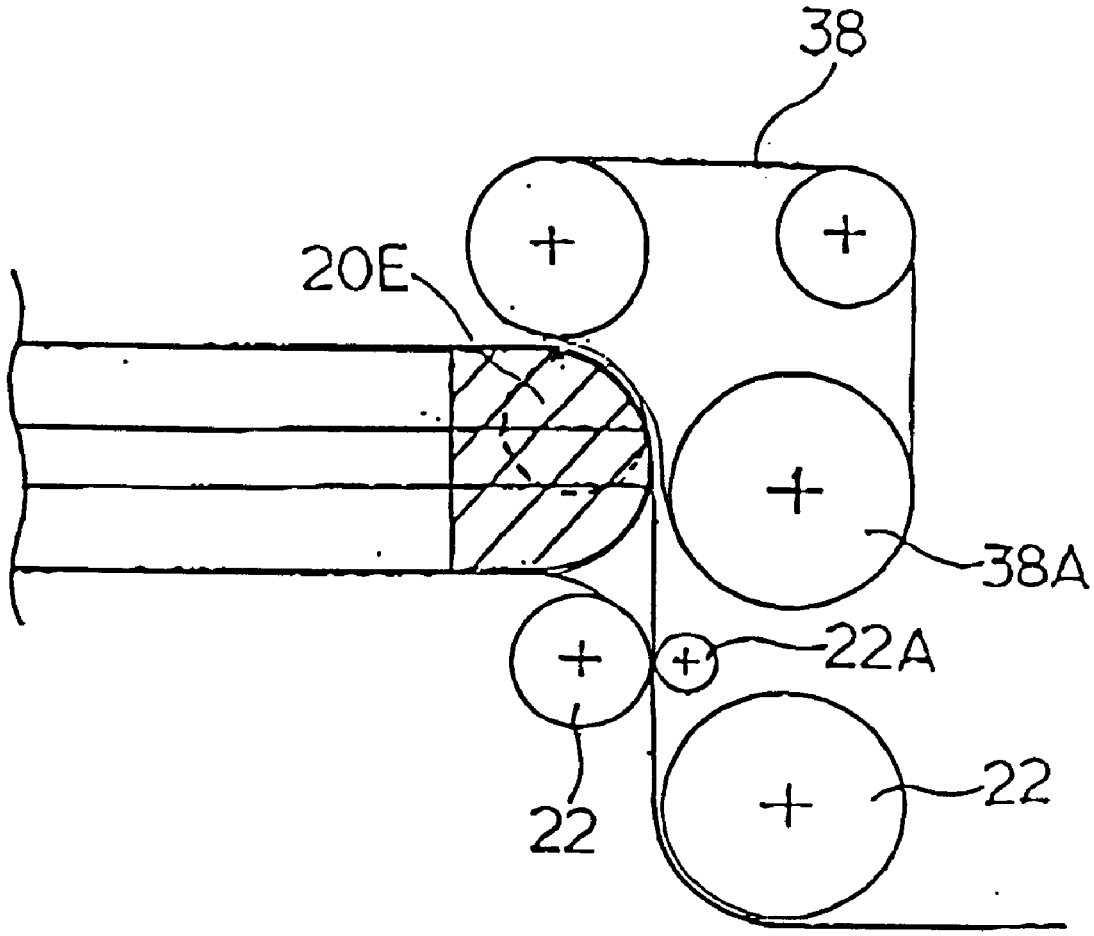
FIG. 6 is a sectional view illustrating a major portion of another embodiment of the present invention.

FIG. 6 illustrates another embodiment of the floating separator 20. Means for limiting the direction of progress at the end of the floating separator may be constituted by using an endless belt 38 that is wrapped round three rolls (including roll 38A) in addition to the upper and lower rolls of two stages. This makes it possible to receive the end of the floating separator by a soft surface to limit it. Further, a roller 20E is pivotally attached to the end of the floating separator to bear a rolling resistance instead of the slide frictional resistance thereby to further decrease the coefficient of friction $\mu$.

Means for limiting the movement of the floating separator in the direction of width on the side surfaces thereof is, most simply, constituted by a pair of, or two or more pairs of, rolls (not shown) pivotally arranged or fixed guides with their axial direction being oriented nearly vertically maintaining a small gap on both sides thereof, or is constituted by an endless belt wrapped round the rolls (a pair or more pairs of rolls) in the lengthwise direction. These rolls or other means determine the position of the floating separator in the direction of its width, and do not exert a large pushing force at all times as compared to means for limiting the direction of progress of the floating separator, that is pushed thereto at all times. Therefore, this means may simply be so designed as will not cause scratches to the film tube that is fed.

The present invention makes it possible to accomplish all of the above-mentioned objects.

That is, in producing a bag using the tube film as a blank, use of the floating separator makes it possible to mass-produce the protection bags of a plastic film having openings of complex patterns which are asymmetrical in the upper and lower surfaces, without the need for manually executing double-size blanking, at a reduced cost.

While the present invention has been described by means of certain preferred embodiments, one of ordinary skill in the art will recognize that modifications, improvements, additions, deletions and substitutions may be made while remaining within the scope and spirit of the appended claims.

What is claimed is:

1. A method of automatically producing bags with openings therein, comprising the steps of:

(a) providing a film tube having a width;

(b) providing an apparatus for automatically producing bags with openings wherein the apparatus comprises:

(i) a pay-off reel for supplying the film tube in a lengthwise direction;

(ii) a device for making openings in the film tube;

(iii) a floating separator for inserting in the film tube at a position along the lengthwise direction corresponding with the device for making openings, wherein the floating separator is limited from moving in the lengthwise direction and in a direction of a width of the film tube, wherein the floating separator serves as a cradle or block against which the device for making openings makes openings in at least one surface of the film tube, and wherein the floating separator comprises a core member sensitive to magnetism, wherein the core member is selected from the group consisting of one or more mild steel plates and a plastic molded member in which ferrite is disposed; and (iv) an electromagnet disposed to impart magnetic force to the floating separator to reduce pressure on a lower surface of the film tube;

(c) imparting magnetic force to the floating separator using the electromagnet to reduce pressure on a lower surface of the film tube;

(d) moving the film tube in a lengthwise direction;

(e) inserting the floating separator in the film tube;

(f) limiting the movement of the floating separator in the direction of width and in the lengthwise direction;

(g) intermittently stopping the movement of the film tube; and (h) forming openings in at least one surface of the film tube during the intermittent stopping of movement of the film tube using the device for making openings.

2. A method of automatically producing bags with openings according to claim 1, wherein said step of limiting is carried out by rolls, endless belts, or fixed guides.

3. A method of automatically producing bags with openings according to claim 1, further comprising the step of:

maintaining the electromagnet at a temperature close to absolute zero.

4. A method of automatically producing bags with openings according to claim 1, further comprising the step of electromagnetically supporting the floating separator.

5. A method of automatically producing bags with openings according to claim 4, wherein said step of limiting is carried out by rolls, endless belts, or fixed guides.

6. An apparatus for automatically producing bags with openings, comprising:

a pay-off reel for supplying a film tube in a lengthwise direction;

a device for making openings in the film tube;

a floating separator inserted in the film tube at a position along the lengthwise direction corresponding with the opening device, wherein the floating separator is limited from moving in the lengthwise direction and in a direction of a width of the film tube, and wherein the floating separator serves as a cradle or block against which the device for making openings makes openings in at least one surface of the film tube, and wherein the floating separator comprises a core member sensitive to magnetism, wherein the core member sensitive to magnetism is selected from the group consisting of one or more mild steel plates and a plastic molded member in which ferrite is disposed; and an electromagnet disposed to impart magnetic force to the floating separator to reduce pressure on a lower surface of the film tube.

7. An apparatus according to claim 6, further comprising:

a loop device arranged to make a loop of film tube ahead of the device for making openings, at least one melt-adhering device arranged to melt adhere the film tube into individual product bags, a predetermined length-drawing device and a cutting device arranged to cut the film tube into individual product bags.

8. An apparatus according to claim 7, wherein the melt-adhering device is a linear heat welder having one or more stages.

9. An apparatus according to claim 6, wherein said device for making openings is selected from the group consisting of a shearing relief and a heated relief.

10. An apparatus according to claim 9, wherein said shearing relief has an opening portion of a relatively wide area for passing a protruded portion of a material packaged in a product bag.

11. An apparatus according to claim 9, wherein said heated relief has an opening portion of a relatively small area for passing a cord or a rubber cord used for fastening the opening or the periphery of the opening after a material is packaged in the product bag.

12. An apparatus according to claim 6, wherein the device for making openings is arranged to leave a portion of the film tube without openings.

13. An apparatus according to claim 6, wherein the movement of the floating separator in the lengthwise direction is limited by a pair of upper and lower rolls that are symmetrically arranged to come in contact with upper and lower surfaces of the film tube to satisfy a relation $T_1>T_2$, wherein $T_1$ is the thickness of the floating separator and $T_2$ is a gap between the rolls.

14. An apparatus according to claim 6, wherein the movement of the floating separator is limited in the lengthwise direction by one or more of rolls asymmetrically arranged up and down, endless belts and fixed guides.

15. An apparatus according to claim 6, wherein the movement of the floating separator is limited in the lengthwise direction by a pair of rollers, endless belts or fixed guides arranged on outer sides of the film tube in the direction of a width of the film tube and pivotally attached to a base plate along a nearly vertical axis.

16. An apparatus according to claim 6, wherein the electromagnet is arranged to suspend the floating separator.

17. An apparatus according to claim 6, wherein the floating separator further comprises a roll at one end, arranged to prevent the film tube from biting that end of the separator.

18. An apparatus according to claim 6, wherein the floating separator further comprises a surface having a small coefficient of friction.

19. An apparatus according to claim 6, wherein the device for making openings comprises a punch and the floating separator further comprises one or more grooves for receiving the punch.

20. An apparatus according to claim 6, wherein the device for making openings comprises at least one punch above the floating separator, and at least one punch below the floating separator, and the floating separator further comprises one or more grooves for receiving the punches.

21. An apparatus according to claim 20, wherein the at least one punch above the floating separator, and the at least one punch below the floating separator are arranged asymmetrically.

22. An apparatus according to claim 6, wherein the electromagnet is contained in a vacuum chamber and maintained at a temperature close to absolute zero.

* * * * *